US010590363B2

(12) United States Patent
Saccomando et al.

(10) Patent No.: US 10,590,363 B2
(45) Date of Patent: Mar. 17, 2020

(54) ASHLESS-FRICTION MODIFIERS FOR LUBRICATING COMPOSITIONS

(71) Applicants: Daniel J. Saccomando, Sheffield (GB); Scott Capitosti, Perry, OH (US); William R. S. Barton, Belper (GB)

(72) Inventors: Daniel J. Saccomando, Sheffield (GB); Scott Capitosti, Perry, OH (US); William R. S. Barton, Belper (GB)

( * ) Notice: Subject to any disclaimer, the term of this patent is extended or adjusted under 35 U.S.C. 154(b) by 0 days.

(21) Appl. No.: 14/354,021

(22) PCT Filed: Oct. 11, 2012

(86) PCT No.: PCT/US2012/059635

§ 371 (c)(1),
(2) Date: Apr. 24, 2014

(87) PCT Pub. No.: WO2013/066585

PCT Pub. Date: May 10, 2013

(65) Prior Publication Data

US 2014/0303054 A1 Oct. 9, 2014

Related U.S. Application Data

(60) Provisional application No. 61/553,337, filed on Oct. 31, 2011.

(51) Int. Cl.

| | |
|---|---|
| ***C07D 233/14*** | (2006.01) |
| ***C10L 1/18*** | (2006.01) |
| ***C10M 129/24*** | (2006.01) |

(52) U.S. Cl.

CPC .. *C10M 129/24* (2013.01); *C10M 2203/1025* (2013.01); *C10M 2207/026* (2013.01); *C10M 2207/028* (2013.01); *C10M 2207/042* (2013.01); *C10M 2207/08* (2013.01); *C10M 2207/24* (2013.01); *C10M 2207/262* (2013.01); *C10M 2207/281* (2013.01); *C10M 2207/289* (2013.01); *C10M 2215/04* (2013.01); *C10M 2215/064* (2013.01); *C10M 2215/082* (2013.01); *C10M 2215/086* (2013.01); *C10M 2215/221* (2013.01); *C10M 2215/28* (2013.01); *C10M 2219/046* (2013.01); *C10M 2219/089* (2013.01); *C10M 2223/043* (2013.01); *C10M 2223/045* (2013.01); *C10N 2230/06* (2013.01); *C10N 2230/40* (2013.01); *C10N 2230/42* (2013.01); *C10N 2230/43* (2013.01); *C10N 2230/45* (2013.01); *C10N 2240/04* (2013.01); *C10N 2240/042* (2013.01); *C10N 2240/044* (2013.01); *C10N 2240/046* (2013.01); *C10N 2240/08* (2013.01); *C10N 2240/10* (2013.01)

(58) Field of Classification Search

CPC ..... C10M 129/24; C10M 2207/08
USPC ..... 508/577, 578, 283
See application file for complete search history.

(56) References Cited

U.S. PATENT DOCUMENTS

| | | | | |
|---|---|---|---|---|
| 2,365,291 | A | 12/1944 | Prutton et al. | |
| 2,443,578 | A | 6/1948 | Fuller et al. | |
| 3,250,710 | A | 5/1966 | Hunt | |
| 4,237,022 | A | 12/1980 | Barrer | |
| 4,478,604 | A | 10/1984 | Schuettenberg | |
| 4,640,787 | A | 2/1987 | Schuettenberg | |
| 4,692,257 | A | 9/1987 | Horodysky | |
| 5,338,470 | A | 8/1994 | Hiebert et al. | |
| 5,380,449 | A | 1/1995 | Thomas et al. | |
| 5,387,351 | A | 2/1995 | Kumar et al. | |
| 6,008,169 | A | 12/1999 | Kaneko | |
| 2004/0147413 | A1 | 7/2004 | Spall et al. | |
| 2005/0198894 | A1 | 9/2005 | Migdal et al. | |
| 2007/0298989 | A1* | 12/2007 | Poirier | C10M 105/18 508/580 |
| 2008/0248979 | A1* | 10/2008 | Nakagawa | B82Y 30/00 508/128 |
| 2011/0086784 | A1 | 4/2011 | Eidenschink et al. | |
| 2011/0143980 | A1 | 6/2011 | Bhalla et al. | |

FOREIGN PATENT DOCUMENTS

| | | | |
|---|---|---|---|
| CA | 1183125 | A | 2/1985 |
| GB | 2105743 | A | 3/1983 |
| JP | 2005-264148 | A | 9/2005 |
| WO | 2005/087904 | A2 | 9/2005 |
| WO | 2008/144701 | A1 | 11/2008 |
| WO | 2008/147700 | A1 | 12/2008 |
| WO | 2008/147704 | A1 | 12/2008 |
| WO | 2010/096167 | A1 | 8/2010 |
| WO | 2010/096168 | A1 | 8/2010 |
| WO | 2010/096169 | A1 | 8/2010 |

* cited by examiner

*Primary Examiner* — Prem C Singh
*Assistant Examiner* — Francis C Campanell
(74) *Attorney, Agent, or Firm* — Iken Sans; Christopher D. Hilker

(57) ABSTRACT

The invention provides a lubricating composition containing an oil of lubricating viscosity and an ashless ketone compound with at least one of a hydroxy group and an ether linkage attached to the carbon atom adjacent to the carbonyl carbon of the ketone, especially α-hydroxyketone. The invention further relates to methods of lubricating an internal combustion engine by supplying the described lubricating composition to the internal combustion engine. The invention further relates to the use of the α-hydroxyketone compound as a friction modifier and an antiwear agent.

10 Claims, No Drawings

ASHLESS-FRICTION MODIFIERS FOR LUBRICATING COMPOSITIONS

FIELD OF INVENTION

The invention provides lubricating compositions containing an α-hydroxy-ketone and an oil of lubricating viscosity. The invention further relates to the use of the lubricating composition in an internal combustion engine. The invention further relates to the use of the α-hydroxy-ketone as a friction modifier.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminum based components), bearing corrosion and/or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Friction modifiers and other additives may also increase lead corrosion.

Further, engine lubricants containing phosphorus and sulfur compounds such as ZDDP have been shown to contribute in part to particulate emissions and emissions of other pollutants. In addition, sulfur and phosphorus tend to poison the catalysts used in catalytic converters, resulting in a reduction in performance of said catalysts.

There has been a commercial trend for reduction in emissions (typically reduction of NOx formation, SOx formation) and a reduction in sulfated ash in engine oil lubricants. Consequently, the amounts of phosphorus-containing antiwear agents such as ZDDP, overbased detergents such as calcium or magnesium sulfonates and phenates have been reduced. As a consequence, there is increasing interest in ashless additives that provide friction, antiwear, or antioxidant performance at least as good as, or even better than, the non-ashless additives discussed above. It is known that surface active ashless compounds such as ashless friction modifiers may in some instances increase corrosion of metal, namely, copper or lead. Copper and lead corrosion may be from bearings and other metal engine components derived from alloys using copper or lead. Consequently, there may be a need to reduce the amount of corrosion caused by ashless additives.

U.S. Pat. No. 3,250,710 discloses a process for preparing overbased polyvalent metal sulfonates. Among a list of suitable lists of dispersing aids, 3-hydroxy-2-butanone is disclosed.

United States Patent Application 2011/0143980 discloses oil-soluble titanium complexes derived from various α-, β-, and γ-hydroxy-carbonyl compounds (or anions thereof), including α-hydroxy-ketones. However there is no teaching of the disclosed carbonyl compounds as additives themselves, but only as precursors to additives.

A variety of patent publications such as CA 1 183 125, U.S. Pat. No. 5,387,351, U.S. 2005/0198894, U.S. Pat. Nos. 4,640,787, 4,692,257, 4,478,604, 4,237,022, GB 2 105 743, U.S. Pat. Nos. 2,443,578, 2,365,291, 5,338,470, WO 2005/087904, WO 2008/147700, WO 2008/147704, and WO 2008/144701 disclose different lubricating compositions containing hydroxycarboxylic acid amides, imides and esters as ashless antiwear agents and/or friction modifiers. None of these references disclose hydroxy-substituted ketones.

International publications WO 2010/096167, WO 2010/096168, and WO 2010/096169 disclose method of reducing wear or friction, and deposit formation and oxidation respectively. The compositions disclosed in the three international publications include lubricating compositions containing a base oil, and at least one additive selected from an antioxidant, a dispersant, a detergent or an anti-wear agent. None of these references disclose α-hydroxy-ketones.

SUMMARY OF THE INVENTION

The invention provides a lubricating composition that is capable of providing friction modification (particularly for enhancing fuel economy), antiwear performance, extreme pressure performance, antioxidant performance, lead, tin or copper (typically lead) corrosion inhibition, decreased corrosiveness towards acrylate or fluoro-elastomer seals, seal swell performance, or some combination thereof.

The present invention provides a lubricating composition containing an oil of lubricating viscosity and an additive comprising a ketone compound with at least one of a hydroxyl group, an ether linkage, or a mixture thereof attached to the carbon atom adjacent to the carbonyl carbon (i.e. in the alpha position). Compounds of this type are referred to herein as α-hydroxyketones. Also included in the described α-hydroxyketones are polyhydroxyketones, including symmetrical dihydroxyketones and dihydroxyketones that include a hydroxyl group or ether linkage attached to the carbon atom adjacent to the carbonyl carbon (i.e. in the alpha position) and then also a hydroxyl group or ether linkage attached to the next adjacent carbon atom (i.e. in the beta position).

The invention further provides a method of making the described α-hydroxyketones.

The invention further provides a method of lubricating an internal combustion engine comprising the step of: (I) supplying to the internal combustion engine the lubricating composition described herein.

The invention further provides the use of the described α-hydroxyketones as friction modifiers, as antiwear performance additives, as extreme pressure additives, as antioxidants, as lead, tin, or copper corrosion inhibitions, as seal protectants, or as seal swell additives.

DETAILED DESCRIPTION OF THE INVENTION

Various preferred features and embodiments will be described below by way of non-limiting illustration.

The amounts of additives present in the lubricating composition disclosed herein are quoted on an oil free basis, i.e. amount of actives, unless otherwise noted.

The α-hydroxyketone

The present invention provides a lubricating composition containing an oil of lubricating viscosity and an additive comprising a ketone compound with a hydroxyl group or ether linkage attached to the carbon atom adjacent to the carbonyl carbon (i.e. in the alpha position).

In one embodiment the ketone comprises a compound represented by formula (1):

Formula (1)

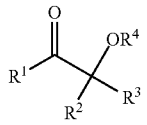

wherein $R^1$ is a linear or branched hydrocarbyl group containing 1 to 40 carbon; and $R^2$, $R^3$ and $R^4$ are each independently hydrogen or linear or branched hydrocarbyl groups containing 1 to 30 carbon atoms. Hydrocarbyl groups $R^1$ and $R^2$ taken together may form 5-membered or 6-membered saturated or unsaturated hydrocarbyl rings. Independently hydrocarbyl groups $R^3$ and $R^4$ taken together may form 5-membered or 6-membered saturated or unsaturated hydrocarbyl rings. In some embodiments $R^1$ contains one or more oxygen atoms but is otherwise made up of only carbon and hydrogen atoms. In other embodiments $R^1$ is an alkyl group free of oxygen atoms and any other hetero atoms. In still other embodiments $R^1$ can be: —$C(R^2)(R^3)(OR^4)$; —C(=O)—$R^2$; —C(=O)—$C(R^2)(R^3)(OR^4)$; where in all of these embodiments $R^2$, $R^3$ and $R^4$ have the same definitions provided above In one embodiment, $R^1$ may be a linear or branched hydrocarbyl group containing 1 to 40, or 4 to 30, or 8 to 20, or 10 to 16 carbon atoms.

In one embodiment $R^2$, $R^3$, and $R^4$ are hydrogen, and $R^1$ is a nitrogen-free hydrocarbyl group containing 8 to 20 carbon atoms. In one embodiment, $R^1$ is a linear or branched alkyl group containing 8 to 20 carbon atoms.

In one embodiment $R^2$, $R^3$, and $R^4$ may be independently nitrogen-free linear or branched hydrocarbyl groups of 1 to 20, or 1 to 10, or 1 to 6 carbon atoms.

In one embodiment, the α-hydroxyketone (typically a compound of formula 1), is not part of a metal-containing complex. In one embodiment, the α-hydroxyketone contains less than 5% or less than 3% or less than 1% of a metal, metal-containing compound, or material that contributes to sulfated ash. In one embodiment, the α-hydroxyketone is free of transition metals, alkali metals, alkaline earth metals, or combinations thereof. In one embodiment, the α-hydroxyketone is free of titanium.

In one embodiment the ketone compound of the invention (typically a compound of formula (1)) may be present in a lubricating composition in a range of 0.01 wt % to 5 wt %, or 0.1 wt % to 4 wt %, or 0.2 wt % to 3 wt %, or 0.5 wt % to 2 wt %, or 0.05 wt % to 0.5 wt % of the lubricating composition.

The α-hydroxyketone may be 1-hydroxy-2-dodecanone, 1-hydroxy-2-tetradecanone, 1-hydroxy-2-hexadecanone, 1-hydroxy-2-octadecanone, or any combination thereof.

In one embodiment, the α-hydroxyketone may be derived from linear or branched α-olefins or from linear or branched hydrocarbyl-1,2-diols. Suitable α-olefins (also 1-olefins) include those having 4 to 40, or 6 to 30, or 10 to 20 carbon atoms. Examples of suitable α-olefins include 1-decene, 1-dodecene, 1-tetradecene, 1-hexadecene, and 1-octadecene. Suitable 1,2-diols include those having 4 to 40, or 6 to 30, or 10 to 20 carbon atoms.

In some embodiments the α-hydroxyketones of the invention comprise a ketone compound with a hydroxyl group or ether linkage attached to the carbon atom adjacent to the carbonyl carbon (i.e. in the alpha position) and then another hydroxyl group or ether linkage on the next adjacent carbon atom (i.e. in the beta position). Such materials may be referred to as dihydroxyketones and, in some embodiments could be prepared by reacting a carbonyl-containing alcohol, such as acetone alcohol (also known as 1-hydroxypropan-2-one), with an aldehyde, for example propanal, decanal, 4-methylbenzaldehyde, and various other materials.

Suitable carbonyl-containing alcohols include those of the formula HO—$R^5$—C(=O)—$R^6$ where each $R^5$ and $R^6$ is independently a hydrocarbyl group, $R^5$ being a hydrocarbylene, or divalent, group and $R^6$ being a monovalent hydrocarbyl group. In some embodiments $R^6$ can be any of the groups defined for $R^1$ above while $R^5$ is generally a single carbon atom, that becomes the carbon adjacent to the carbonyl group in the resulting dihydroxyketone compound.

Suitable aldehydes include those of the formula H—C(=O)—$R^7$ where each $R^7$ is a hydrocarbyl group. In some embodiments $R^6$ can be any of the groups defined for $R^2$ or $R^3$ above. The aldehyde can effectively become the $R^2$ shown in Formula I above where it is understood that the $R^2$ groups is a hydroxyl containing hydrocarbyl group with the hydroxyl group located on the first carbon atom of the group. In such embodiments $R^3$ in the formula above will generally be hydrogen.

In such embodiments where the ketone is a dihydroxyketone compound, the compound can be represented by formula (2):

Formula (2)

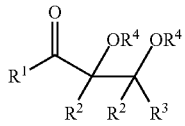

Wherein all of the groups $R^1$, $R^2$, $R^3$, and $R^4$ can each be any of the groups defined for each group above for Formula (1). In some embodiments: $R^1$ is a small alkyl group, for example a methyl group; each $R^2$ groups is hydrogen; the $R^3$ group is a hydrocarbyl group, linear or branched, containing 1 to 30 carbon atoms, and in some embodiments is a linear hydrocarbyl group, or even an alkyl group (free of hetero atoms) containing from 6 to 20, 8 to 16 or even about 8 to 12, or even 10 carbon atoms; and each $R^4$ group is hydrogen.

Oils of Lubricating Viscosity

The lubricating compositions of the invention comprise an oil of lubricating viscosity. Suitable oils include both natural and synthetic oils, oil derived from hydrocracking, hydrogenation, and hydrofinishing, unrefined, refined, re-refined oils or mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized, oligomerised, or interpolymerised olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as poly α-olefins, and mixtures thereof alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Additional Performance Additives

The compositions of the invention may optionally comprise one or more addition performance additives. These additional performance additives may include one or more metal deactivators, viscosity modifiers, detergents, friction modifiers (other than the compound of the present invention), antiwear agents (other than the compound of the present invention), corrosion inhibitors (other than the compound of the present invention), dispersants, dispersant viscosity modifiers, extreme pressure agents, antioxidants, foam inhibitors, demulsifiers, pour point depressants, seal swelling agents, and any combination or mixture thereof. Typically, fully-formulated lubricating oil will contain one or more of these performance additives, and often a package of multiple performance additives.

In one embodiment the invention provides a lubricating composition further comprising a dispersant, an antiwear agent (other than the compound of the present invention), a dispersant viscosity modifier, a friction modifier, a viscosity modifier, an antioxidant, an overbased detergent, or a combination thereof, where each of the additives listed may be a mixture of two or more of that type of additive. In one embodiment the invention provides a lubricating composition further comprising a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates and phenates), or a combination thereof, where each of the additives listed may be a mixture of two or more of that type of additive.

In one embodiment the lubricating composition of the invention further includes an antiwear agent such as a metal dihydrocarbyl dithiophosphate (typically zinc dialkyldithiophosphate), wherein the metal dihydrocarbyl dithiophosphate contributes at least 100 ppm, or at least 200 ppm, or 200 ppm to 1000 ppm, or 300 ppm to 800 ppm, or 400 ppm to 600 ppm of phosphorus to the lubricating composition. In one embodiment, the lubricating composition is free of or substantially free of zinc dialkyldithiophosphate (ZDDP).

Suitable dispersants for use in the compositions of the present invention include succinimide dispersants. In one embodiment the dispersant may be present as a single dispersant. In one embodiment the dispersant may be present as a mixture of two or three different dispersants, wherein at least one may be a succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

Suitable dispersant viscosity modifiers include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulfur containing phenates, sulfur containing phenates, sulfonates, salixarates, salicylates, and mixtures thereof.

The overbased detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Typically an overbased detergent may be sodium salts, calcium salts, magnesium salts, or mixtures thereof of the phenates, sulfur containing phenates, sulfonates, salixarates and salicylates. Overbased phenates and salicylates, typically have a total base number of 180 to 450 TBN. Overbased sulfonates typically have a total base number of 250 to 600, or 300 to 500. Overbased detergents are known in the art. In one embodiment the sulfonate detergent may be predominantly a linear alkylbenzene sulfonate detergent having a metal ratio of at least 8 as is described in paragraphs [0026] to [0037] of US Patent Application 2005065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances in predominantly in the 2 position, resulting in the linear alkylbenzene sulfonate detergent. Overbased detergents are known in the art. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at or 2 wt % to 3 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulfurized olefins, alkylated diarylamines (typically alkylated phenyl naphthyl amines for example those commercially available as Irganox® L 06 from CIBA, or alkylated diphenylamines such as dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of additional friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. In some embodiments the term fatty, as used herein, can mean having a C8-22 linear alkyl group.

Friction modifiers may also encompass materials such as sulfurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment the friction modifier may be a long chain fatty acid ester. In another embodiment the long chain fatty acid ester may be a mono-ester or a diester or a mixture thereof, and in another embodiment the long chain fatty acid ester may be a triglyceride.

Other performance additives such as corrosion inhibitors include those described in paragraphs 5 to 8 of US Application US05/038319, published as WO2006/047486, octyl octanamide, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Additive of Invention (typically of formula (1) | 0.05 to 1 | 0.2 to 3 | 0.5 to 2 |
| Dispersant | 0.05 to 12 | 0.75 to 8 | 0.5 to 6 |
| Dispersant Viscosity Modifier | 0 or 0.05 to 5 | 0 or 0.05 to 4 | 0.05 to 2 |
| Overbased Detergent | 0 or 0.05 to 15 | 0.1 to 10 | 0.2 to 8 |
| Antioxidant | 0 or 0.05 to 15 | 0.1 to 10 | 0.5 to 5 |
| Antiwear Agent | 0 or 0.05 to 15 | 0.1 to 10 | 0.3 to 5 |
| Friction Modifier | 0 or 0.05 to 6 | 0.05 to 4 | 0.1 to 2 |
| Viscosity Modifier | 0 or 0.05 to 10 | 0.5 to 8 | 1 to 6 |
| Any Other Performance Additive | 0 or 0.05 to 10 | 0 or 0.05 to 8 | 0 or 0.05 to 6 |
| Oil of Lubricating Viscosity | Balance to 100% | Balance to 100% | Balance to 100% |

The α-hydroxyketone of the invention (typically of formula (1)) may be present in embodiments (D) 0.1 wt % to 8 wt %, or (E) 1 wt % to 7 wt %, or (F) 2 wt % to 6 wt % of the lubricating composition, with the amount of dispersant viscosity modifier, overbased detergent, antioxidant, antiwear agent, friction modifier, viscosity modifier, any other performance additive (excluding a dispersant) and an oil of lubricating viscosity in amounts shown in the table above for embodiments (A) to (C). The compound of invention derived from formula (1) or formula (4) may also exhibit dispersant performance. If the compound of invention derived from formula (1) or formula (4) exhibits dispersant performance, a portion or all of the dispersant ranges quoted in embodiments (D) to (F) may be 0 wt % to 12 wt %, or 0 wt % to 8 wt % or 0 wt % to 6 wt % of the lubricating composition.

Industrial Application

In one embodiment the invention provides a method of lubricating an internal combustion engine comprising the step of supplying to the internal combustion engine a lubricating composition as disclosed herein. Generally the lubricant is added to the lubricating system of the internal combustion engine, which then delivers the lubricating composition to the critical parts of the engine, during its operation, that require lubrication.

In one embodiment the invention provides for the use of the α-hydroxyketone compound, described herein, as at least one of a friction modifier, an antioxidant, a dispersant, an antiwear agent, an extreme pressure agent, a lead, tin or copper (typically lead) corrosion inhibitor, a seal additive that decreases corrosion of acrylate or fluoro-elastomer seals, or a seal additive to improve seal swell performance.

The lubricating compositions described above may be utilized in an internal combustion engine. The engine components may have a surface of steel or aluminum (typically a surface of steel), and may also be coated for example with a diamond like carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The internal combustion engine of the present invention is distinct from gas turbine. In an internal combustion engine individual combustion events which through the rod and crankshaft translate from a linear reciprocating force into a rotational torque. In contrast, in a gas turbine (may also be referred to as a jet engine) it is a continuous combustion process that generates a rotational torque continuously without translation and can also develop thrust at the exhaust outlet. These differences result in the operation conditions of a gas turbine and internal combustion engine different operating environments and stresses.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulfated ash content may be 0.05 wt % to 0.9 wt %, or 0.1 wt % to 0.2 wt % or to 0.45 wt %.

In one embodiment the lubricating composition may be an engine oil, wherein the lubricating composition may be characterized as having at least one of (i) a sulfur content of 0.5 wt % or less, (ii) a phosphorus content of 0.1 wt % or less, (iii) a sulfated ash content of 1.5 wt % or less, or combinations thereof.

EXAMPLES

The invention will be further illustrated by the following examples, which set forth particularly advantageous embodiments. While the examples are provided to illustrate the invention, they are not intended to limit it.

Additive A

Additive A (ADD A) is 1-hydroxyl-2-dodecanone and is prepared as follows. A 3 L 3-neck round bottom flask is equipped with a stirrer, thermocouple, nitrogen inlet, condenser and placed inside a bath suitable for cooling. To the flask is added acetic acid (500 mL) followed by dodecane-1,2-diol (120 g). The mixture is stirred until dissolution is nearly complete. Over a period of approximately 45 minutes sodium hypochlorite solution (600 mL of a 15% solution in water) is added to the flask during which time the temperature rises inside the flask from 18° C. to approximately 27° C. The reaction mixture is then stirred for approximately 3 hours. The reaction is diluted with water (approx 2000 ml) and then the reaction mass extracted, (by means of a reparatory funnel) 3 times with dichloromethane (3×750 ml), the combined organic phases are combined and washed 3 times with saturated sodium bicarbonate solution (3×1000 ml) and then washed with water (1×1000 ml). The organics are dried with magnesium sulfate and then filtered. The filtrate is vacuum stripped to remove volatile organics and isolate the waxy off-white solid product (92 g).

Additive B

Additive B (ADD B) is 1-hydroxy-2-hexadecanone and is prepared as follows. A 2 L 3-necked flask is charged with acetic acid (500 ml) and Vikinol™ 16 (a commercially available 16 carbon 1,2-dihydroxy alkane from Arkema) (200 g). The flask is equipped with water cooled condenser and nitrogen inlet. Sodium hypochlorite solution (600 ml of a 15% aqueous solution) is charged via a pressure equalizing dropping funnel and added dropwise to the reaction over 2.5 h at room temperature. After stirring for a further 3 h at room temperature and left to stand for 14 hours, the reaction mixture appears as a slurry. The solid is separated by filtration and collected. The solid filtrate is extracted with dichloromethane (3000 ml) which is washed with water (1000 ml) and sodium bicarbonate solution (2×750 mL) and then dried over magnesium sulfate and filtered. The filtrates were vacuum stripped to isolate the product solid wax product.

Additive C

Additive C (ADD C) is 1-hydroxy-2-octadecanone and is prepared using the same procedure described above for Additive B except Vikinol™ 16 is replaced with an 18 carbon atom equivalent.

Additive D

Additive D (ADD D) is 1-hydroxyl-2-octadecanone and is prepared as follows. A 5 L 3-neck round bottom flask is equipped with a stirrer, thermocouple, nitrogen inlet, condenser and placed inside a bath suitable for cooling. To the flask is added acetone (2500 ml), water (200 mL), acetic acid (50 ml) and 1-octadecene (50.7 g). Over a period of approximately 27 minutes potassium permanganate (44.53 g) is added to the flask during which time the temperature rises inside the flask from 22.3° C. to approximately 26.8° C. The reaction mixture is then stirred for approximately 1 to 2 hours and then left to stand overnight. To the reaction is then added sodium nitrite (20.56 g) followed by sulphuric acid solution (405 ml) (8 parts water to 1 part acid) which was added over 12 minutes and the reaction is stirred for at least one hour. During this time the product precipitates out of solution, other manganese based solids sink to the bottom of the flask and so the product slurry is collected by decanting from the reaction mass. The product precipitate is then collected via filtration. The collected white solid is re-dissolved in dichloromethane (or diethyl ether) (1000 ml) and then washed (by means of a reparatory funnel) with 1000 ml of brine and then once with 1000 ml of saturated sodium bicarbonate. The organics are dried with sodium sulfate and then filtered. The filtrate is vacuum stripped to remove volatile organics and isolate the waxy off-white solid product. The product is then further purified by slurrying in 150 ml of hexane and then isolating the solid via filtration to yield 6.6 g of product. Further product can be isolated by addition of 4000 ml of water to the aqueous reaction mass (after the initial product precipitate has been collected), collecting the product via filtration and then repeating the same dissolution in 3000 ml diethyl ether, washing with brine (1×1000 ml), washing with saturated sodium bicarbonate (1×1000 ml), drying with sodium sulphate, filtering and vacuum stripping the filtrates. Finally the product is slurried in approximately 150 ml of hexane. This yields a further 7.9 g of product. Total product isolated, 14.5 g.

Additive E

Additive E (ADD E) is 3,4-dihydroxytetradecan-2-one and is prepared as follows. A 500 ml flask was set up with flange lid, PTFE gasket and gland, overhead stirrer, $N_2$ inlet, thermocouple and water cooled condenser. The reaction vessel was then charged with undecanal (45 g), hydroxyacetone (19.6 g) and DBN (1,5-Diazabicyclo[4.3.0]non-5-ene) (1.6 g) and stirred at room temperature. On stirring the reaction exothermed to 47° C., the exotherm was controlled by blowing the flask with compressed air. The reaction was held for 1 h until the reaction mixture became a pale yellow waxy solid that did not stir. The reaction was cooled and left to stand overnight. Dichloromethane (500 ml) was added to the vessel and stirred to fully dissolve the product. This was then transferred to a separating funnel where it was washed with dilute hydrochloric acid (1:9), 4×250 ml portions. The Dichloromethane layer was then dried over magnesium sulfate, filtered through a sinter funnel and the filtrates were vacuum stripped to remove volatile organics and isolate the waxy off-white solid product (52.95 g).

Lubricating Compositions

A series of 0W-20 engine lubricants in a Group III base oil of lubricating viscosity are prepared containing the additives described above as well as conventional additives including polymeric viscosity modifier, ashless succinimide dispersant, overbased detergents, antioxidants (combination of phenolic ester and diarylamine), zinc dialkyldithiophosphate (ZDDP), as well as other performance additives as follows (Table 1). The phosphorus, sulfur and ash contents of each of the examples are also presented in the table in part to show that each example has a similar amount of these materials and so provide a proper comparison between the comparative and invention examples.

TABLE 1

| Lubricating Oil Composition Formulations | | | | | | | |
|---|---|---|---|---|---|---|---|
| | COMP EX 1 | COMP EX 2 | INV EX 3 | INV EX 6 | INV EX 7 | INV EX 8 | INV EX 9 |
| Base Oil | Balance to = 100% | | | | | | |
| ADD A | 0 | 0 | 0.5 | 0 | 0 | 0 | 0 |
| ADD B | 0 | 0 | 0 | 0.25 | 0.5 | 0 | 0 |
| ADD C | 0 | 0 | 0 | 0 | 0 | 0.25 | 0.5 |
| Friction Modifer[2] | 0 | 0.5 | 0 | 0 | 0 | 0 | 0 |
| Antioxidant | 1.8 | 1.8 | 1.8 | 1.8 | 1.8 | 1.8 | 1.8 |
| ZDDP | 0.76 | 0.76 | 0.76 | 0.76 | 0.76 | 0.76 | 0.76 |
| PMA VM | 4.5 | 4.5 | 4.5 | 4.5 | 4.5 | 4.5 | 4.5 |
| Additional Additives[3] | 5.9 | 5.9 | 5.9 | 5.9 | 5.9 | 5.9 | 5.9 |
| % Phosphorus | 0.076 | 0.076 | 0.076 | 0.076 | 0.076 | 0.076 | 0.076 |
| % Sulfur | 0.24 | 0.24 | 0.24 | 0.24 | 0.24 | 0.24 | 0.24 |
| % Ash | 0.84 | 0.84 | 0.84 | 0.84 | 0.84 | 0.84 | 0.84 |

1 - All amounts shown above are in weight percent and are on an oil-free basis unless otherwise noted.
[2]Oleyl tartrimide, a superior friction modifier used in many lubricating compositions today.
[2]The Additional Additives used in the examples includes a dispersant, a detergent, and an antifoam agent, and includes some amount of diluent oil. The same Additive package is used in each of the examples.

Friction and Wear Performance of α-Hydroxyketones

The lubricating oil composition examples summarized in Table 1 are evaluated for boundary lubrication friction performance and wear in a programmed temperature high frequency reciprocating rig (HFRR). HFRR conditions for the evaluations were 200 g load, 75 minute duration, 1000 micrometer stroke, 20 Hertz frequency, and temperature program of 15 minutes at 40° C., then the temperature is raised to 160° C. at a rate of 2° C./min. The contact potential is measured by applying a small electrical potential between the upper and lower test specimens. The test specimens are steel engine parts. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The wear, and contact coefficient of friction (COF) results obtained are presented in the following table. The results of this testing are summarized in Table 2.

TABLE 2

| Friction and Wear Testing | | | | | | | |
|---|---|---|---|---|---|---|---|
| | COMP EX 1 | COMP EX 2 | INV EX 3 | INV EX 6 | INV EX 7 | INV EX 8 | INV EX 9 |
| Wt % Friction Modifier | 0 | 0.5 | 0.5 | 0.25 | 0.5 | 0.25 | 0.5 |
| COF | 0.12 | 0.079 | 0.088 | 0.089 | 0.088 | 0.082 | 0.079 |
| Wear Scar (μ) | 143 | 141 | 130 | 135 | 125 | 129 | 134 |

The results show that the α-hydroxyketone additives present in the compositions of the invention provides friction performance at least as effectively as oleyl tartrimide, and every inventive example resulted in a lower total wear scar than the comparative examples. Even when comparing the 0.5% wt treat rate of the friction modifier in the comparative example to the 0.25% wt treat rate for the α-hydroxyketone additives of the invention, the inventive examples still provided consistently and significantly improved performance as demonstrated by the wear scar data in the Table 2.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference, as is the priority document and all related applications, if any, which this application claims the benefit of. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms.

Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising an oil of lubricating viscosity and 0.2 wt % to 3 wt %, based on a total weight of the lubricant composition of an ashless α-hydroxyketone represented by the formula:

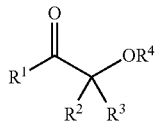

wherein:

$R^1$ is a nitrogen-free alkyl group containing 10 to 16 carbon atoms;

$R^2$ and $R^3$ are each independently hydrogen or a hydrocarbyl group of 1 to 6 carbons;

$R^4$ is hydrogen;

and 0.5 wt % to 1.5 wt % zinc dialkyldithiophosphate, based on a total weight of the lubricating composition.

2. The lubricating composition of claim 1 wherein $R^2$, $R^3$, and $R^4$ are hydrogen.

3. The lubricating composition of claim 1 further comprising an additional antiwear agent, a dispersant viscosity modifier, an additional friction modifier, a viscosity modifier, an antioxidant, an overbased detergent, or mixtures thereof.

4. The lubricating composition of claim 3, wherein the additional friction modifier is selected from the group consisting of long chain fatty acid derivatives of amines, long chain fatty esters, long chain fatty epoxides, fatty imidazolines, amine salts of alkylphosphoric acids, fatty alkyl tartrates, fatty alkyl tartrimides, fatty alkyl tartramides, and combinations thereof.

5. The lubricating composition of claim 1 further comprising an overbased detergent.

6. The lubricating composition of claim 4 wherein the overbased detergent is selected from the group consisting of phenates, sulfur containing phenates, sulfonates, salixarates, salicylates, and mixtures thereof.

7. A method of lubricating a mechanical device comprising supplying to the mechanical device a lubricating composition of claim 1.

8. The method of claim 7 wherein the mechanical device is an internal combustion engine, a hydraulic device, a manual or automatic transmission, an industrial gear, an automotive gear (or axle), or a farm tractor.

9. The lubricating composition of claim 1 comprising 0.5 wt % to 0.9 wt % zinc dialkyldithiophosphate, based on a total weight of the lubricating composition.

10. The lubricating composition of claim 1 comprising 0.25 wt % to 0.5 wt % of said ashless α-hydroxyketone, based on a total weight of the lubricating composition.

* * * * *